United States Patent [19]

Hansen et al.

[11] Patent Number: 4,780,924

[45] Date of Patent: Nov. 1, 1988

[54] TOOTH BRUSH WITH REMOVABLE BRUSH HEAD

[76] Inventors: Paul D. Hansen, 307 Los Pinos Way, San Jose, Calif. 95119; Garrett B. DeCerce, 15003 SE. 143rd Pl., Renton, Wash. 98056; William J. Schmidt, Jr., 2130 Half Rd., Morgan Hill, Calif. 95037

[21] Appl. No.: 110,685

[22] Filed: Oct. 20, 1987

[51] Int. Cl.[4] ..... A46B 9/04

[52] U.S. Cl. ..... 15/176.1; 15/167.1; 15/145; D4/104

[58] Field of Search ..... 15/167.1, 167.2, 143 R, 15/145, 176, 22 R, 22 A, 22 B, 22 C; D4/104–113

[56] References Cited

U.S. PATENT DOCUMENTS

| | | | |
|---|---|---|---|
| 3,072,938 | 1/1963 | Phaneuf | 15/176 X |
| 3,181,189 | 5/1965 | Leyden | 15/145 X |
| 4,592,109 | 6/1986 | Borea et al. | D4/104 |

FOREIGN PATENT DOCUMENTS

| | | | |
|---|---|---|---|
| 2840429 | 3/1980 | Fed. Rep. of Germany | 15/167.1 |
| 412414 | 6/1934 | United Kingdom | 15/167.1 |

*Primary Examiner*—Peter Feldman
*Attorney, Agent, or Firm*—Allston L. Jones

[57] ABSTRACT

A tooth brush with a handle portion in the shape of a bent trapezoid and a head portion affixed thereto, and a latch mechanism to affix two items to each other. The tail region is affixed to one end of the main body region and angled upward with respect to the main body region. The "S" shaped region is affixed to the other end of the main body region with an upper and a lower curved indentation to form the "S". The surfaces of the "S" shaped region that form the "S" are extensions of the top and bottom surfaces of the main body region. Finally, the head portion is affixed to the proximate end of the "S" shaped region, with the head portion having bristles affixed thereto in a selected pattern. The latching mechanism for affixing a first item to a second item includes a male latching portion affixed to the first item, and a cavity defined within the second item disposed to receive the male latching portion. The male latching portion includes a "U" shaped body with the top of each leg of the "U" being affixed to, and extending outward from, the surface of the end of the first item that is to abut the surface of the end of the second item when the first item is affixed to the second item. The male latching portion also includes a spring finger having one end thereof affixed to the same surface to which the legs of the "U" shaped body are affixed and extends outward therefrom between the legs of the "U" shaped body. The spring finger has at its other end a locking tooth that extends outward from between the legs of the "U" shaped body to be captured within the cavity of the second item.

8 Claims, 6 Drawing Sheets

ALL ANGLES TAKEN FROM ℄ OR BASELINE
ALL MEASUREMENTS IN INCHES AND DEGRESS
0.0° BASELINE
.840 WIDE
.695 WIDE
.700 WIDE

FIG. 5a
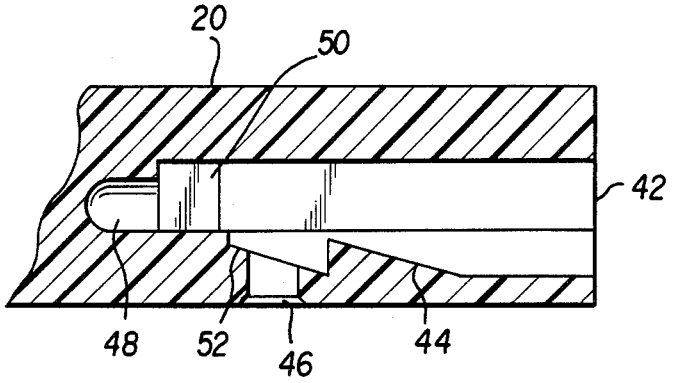
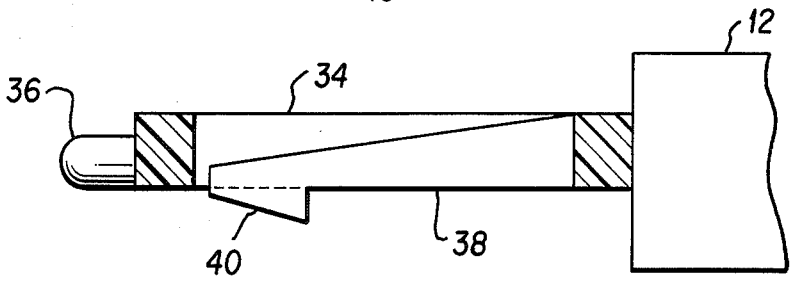
FIG. 5b
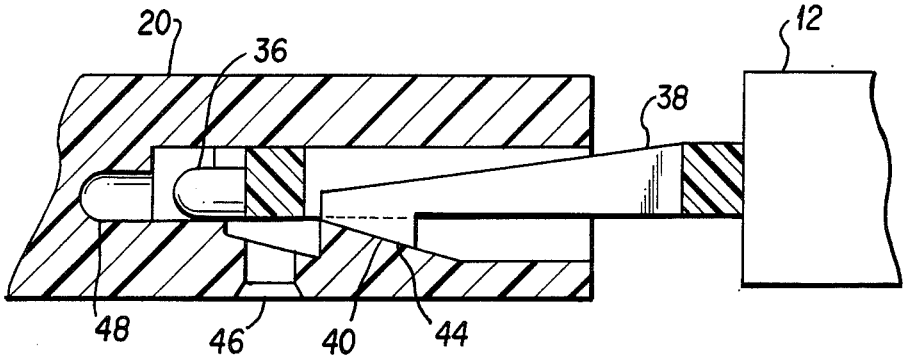
FIG. 5c

TOOTH BRUSH WITH REMOVABLE BRUSH HEAD

BACKGROUND OF THE INVENTION

The present invention relates to tooth brushes having a handle to allow the user to have positive control of the brushing action while being used with either the right or the left hand, and more particularly to tooth brushes having a replaceable brush head when the bristles have worn down.

The prior art includes numerous tooth brushes with various bristle orientations, head angles, and other appliances attached to the handle of the tooth brush. Additionally, there is a tooth brush sold under the name "RADIUS" that has a handle that is shaped to provide positive control of the use of the brush, however, the handle design of that brush is such that there is a right hand model and a left hand model. The bristle layout of this brush is in the shape of an oval which does not provide a good cleaning action when the brush is used. Further, no tooth brush is known to have a replaceable head.

It would be desirable to have a tooth brush that provides for positive control of the brushing action by means of a handle that is designed to be comfortably held by the user in any way that suits him regardless of which hand he uses. In addition, it would be desirable to have replaceable heads for the tooth brush to minimize disease transmission and the cost of the brush to the consumer. The present invention provides such a tooth brush design.

SUMMARY OF THE INVENTION

In accordance with the illustrated embodiments, the present invention provides a tooth brush with a handle portion in the shape of a bent trapezoid and a head portion affixed thereto, and a latch mechanism to affix two items to each other. The tooth brush includes a handle portion with a main body region, a tail region and an "S" shaped region. The main body region is substantially rectalinear in shape with a length that is several times longer than either its height or width. In addition, the main body region defines a top, a bottom and two side surfaces. The tail region is affixed to one end of the main body region and angled upward through a selected angle with the top surface of the main body region. The "S" shaped region is affixed to the other end of the main body region with an upper and a lower curved indentation to form the "S". The surfaces of the "S" shaped region that that form the "S" are extensions of the top and bottom surfaces of the main body region. Finally, the head portion is affixed to the distal end of the "S" shaped region, with the head portion having bristles affixed thereto in a selected pattern.

The latching mechanism for affixing a first item to a second item includes a male latching portion affixed to the first item, and a cavity defined within the second item disposed to receive the male latching portion on the first item. The male latching portion includes a "U" shaped body with the top of each leg of the "U" being affixed to, and extending outward from, the surface of the the end of the first item that is to abut the surface of the end of the second item when the first item is affixed to the second item. The male latching portion also includes a spring finger having one end thereof affixed to the same surface to which the legs of the "U" shaped body are affixed and extends outward therefrom between the legs of the "U" shaped body. The spring finger has at its other end a locking tooth that extends outward from between the legs of the "U" shaped body.

BRIEF DESCRIPTION OF THE FIGURES

FIG. 1*f* shows the cross-sectional shapes of the handle and brush head of the tooth brush of FIGS. 1*a–e*.

FIG. 5*a* shows in a cross-sectional side plan view the cavity into which the male latch portion is received by the end of the handle of the present invention.

FIG. 5*b* shows a cross-sectioned side plan view of the male latch portion of FIGS. 3*a–b* and 4.

FIG. 5*c* shows the male latch portion partially inserted into the cavity of FIG. 5*a* by means of a cross-sectioned side plan view.

DESCRIPTION OF THE PREFERRED EMBODIMENTS

The present invention is an ergonomically designed tooth brush which provides positive control during brushing while being comfortable to grasp in numerous ways with either hand. In addition, the head is designed to be removable when the bristles wear down to minimize the replacement cost of the brush.

Figures 1A, 1B, 1C, 1D, 1E:
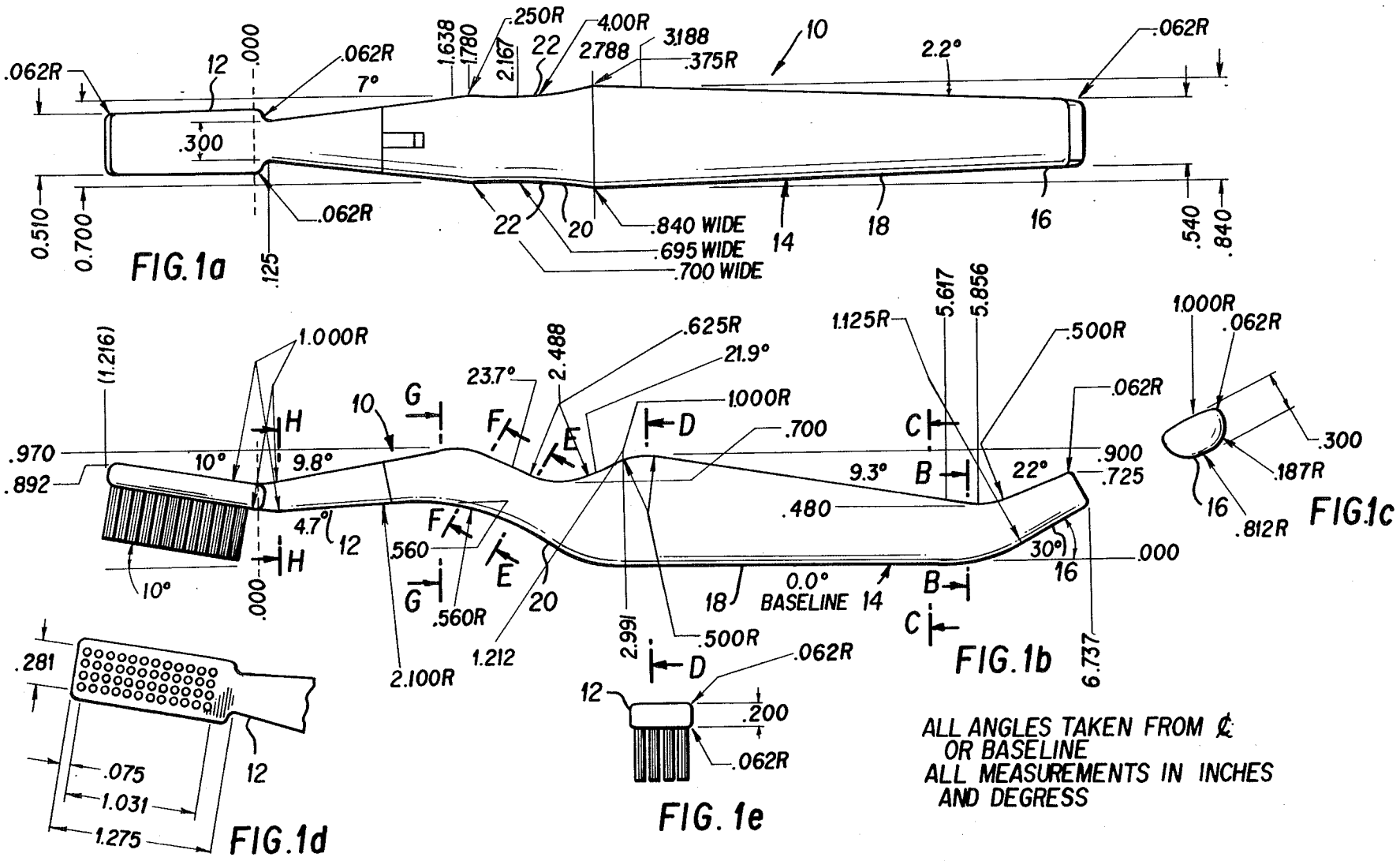
FIGS. 1*a–e* show several plan views of a first embodiment of the tooth brush of the present invention including top, side, both ends, and bristle format views.

Referring to FIGS. 1*a–e* there are shown several views of the tooth brush 10 of a first embodiment of the present invention, and in FIG. 1*f* there are shown the cross-sectional shapes of the handle and head at several points along its length. From these views it can be seen that the handle is a bent trapezoid which is substantially rectangular in cross-section throughout its length. To improve the comfort when the handle is grasped, the corners of the surface of the handle, both radially and axially, are rounded.

Tooth brush 10 has a head portion 12 and a handle portion 14. Head 12 is removably affixed to handle portion 14 to permit the replacement of head portion 12 when the bristles are worn or bacterially infected. Additionally, handle portion 14 has three regions: a main body region 18, a tail region 16 and an "S" shaped region 20. As shown, the head portion 12 attaches to proximate end of the "S" shaped region 20 of the handle portion, which is next followed by the main body region 18 and then the tail region 16. From FIG. 1*b* it can be seen that the radius of curvature of the bristle side of the "S" shaped region 20 is approximately 3.5 times the radius of curvature of the other side of the "S" shaped region 20. Those two indentations are provided to accommodate the thumb and forefinger of the user, and it is those indentations, when the tooth brush is grasped thereby, that provide the control of the brush during usage. Also, in FIG. 1*b* it can be seen that the tail region 16 turns upward with respect to the bristle side of head 12, as does head 12 unlike the prior art which turns downward.

In FIG. 1*a* it can further be seen that the "S" shaped region 20, when viewed from the top or bottom, has a slight hour glass shape as a result of indentations 22. Indentations 22 are also provided to accommodate the thumb and forefinger of the user to control the brush in use, when so held. The main body region 18 and the tail region 16 are provided to accommodate the other three fingers of the user when the tooth brush 10 is being used. Additionally, the tail region 16 is approximately 12% of the overall length of the tooth brush 10 of the present invention and may or may not be contacted during use depending on the way that the user chooses to hold tooth 10 during use thereof.

Figure 6A:
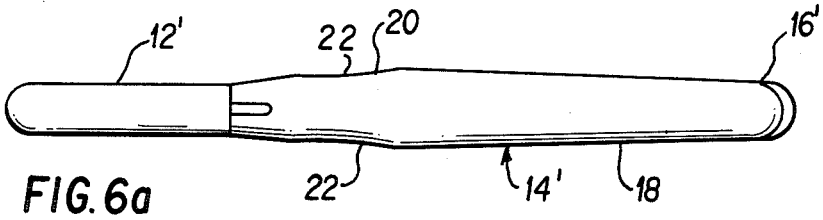
FIGS. 6*a–c* show a top and side plan views, and a bottom plan view of the bristle side of the head portion, of a second embodiment of the tooth brush of the present invention.
Figure 6B:
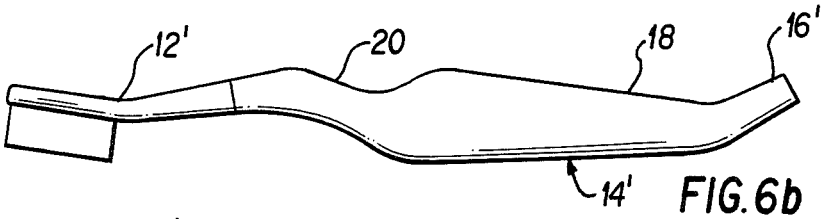
Figure 6C:
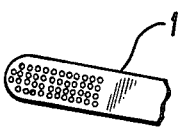

A second embodiment of the tooth brush of the present invention is shown in FIGS. 6*a–c*. The differences between this embodiment and the first embodiment are only in the outline shape of the head portion 12' and tail region 16'. Head portion 12' has a rounded forward end instead of a squared off forward edge as in head portio 12. Additionally, head 12' does not neck down behind the bristles as does head portion 12. The distal end of tail region 16' is also curved instead of substantially square as in tail region 16. Otherwise tooth brush 14' is the same as tooth brush 14.

Figure 2A:
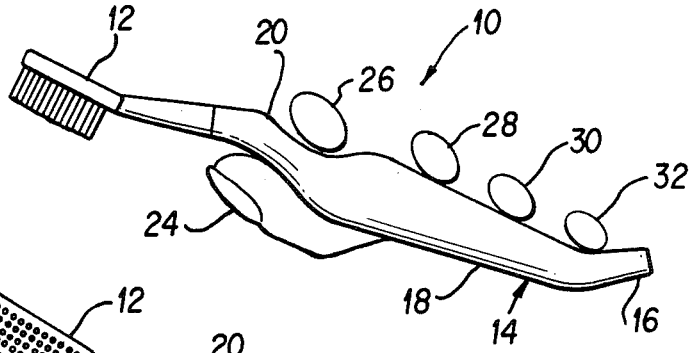
FIGS. 2*a–d* show several ways that the tooth brush of the present invention can be held by the user.

Referring next to FIGS. 2*a–d* there is shown four ways of holding tooth brush 10 with the right hand. For ease of viewing the accommodation of the users fingers 26–32 and thumb 24 as they grasp the handle portion 14, only the portion of the fingers 26–32 and thumb 24 were they contact the handle portion 14 are shown. In FIG. 2*a* the thumb 24 and the forefinger 26 are contacting the large and small radius of curvature sections, respectively, of the "S" shaped region 20 of tooth brush 10, with the other fingers 28–32 being accommodated by the main body region 18 and tail region 16.

Figure 2B:
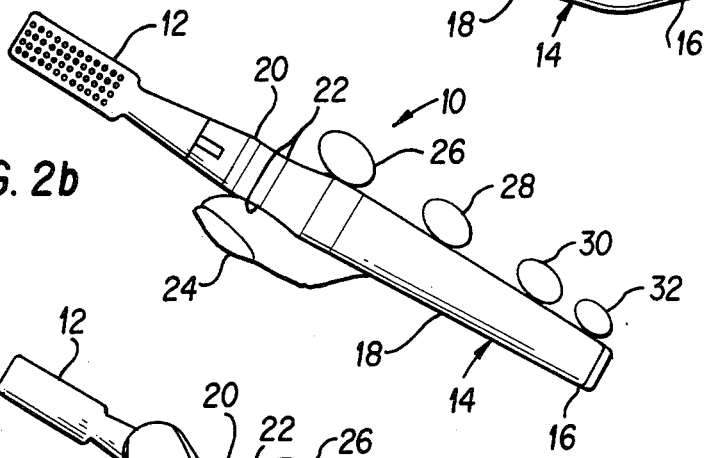

In FIG. 2*b* the thumb 24 and forefinger 26 are grasping the "S" shaped region 20 on opposite sides in indentations 22, with the other fingers 28–32 being accommodated by the main body region 18 and tail region 16.

Figure 2C:
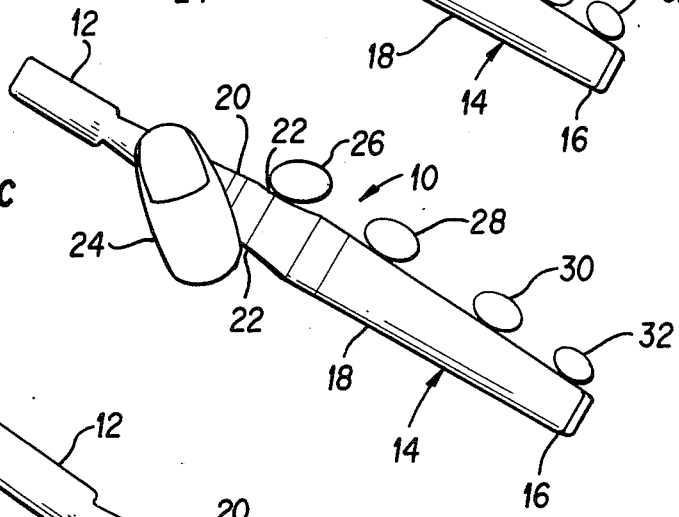

In FIG. 2*c* thumb 24 is in contact with the back of "S" shaped region 20 forward of the smaller radius of curvature indentation and forefinger 26 is in contact with one of indentations 22 and extents beneath the "S" shaped region to make contact with the large radius of curvature indentation on the bottom of handle portion 14. The other fingers 28–32 are, in this view, accommodated by the side of main body region 18 and tail region 16.

Figure 2D:
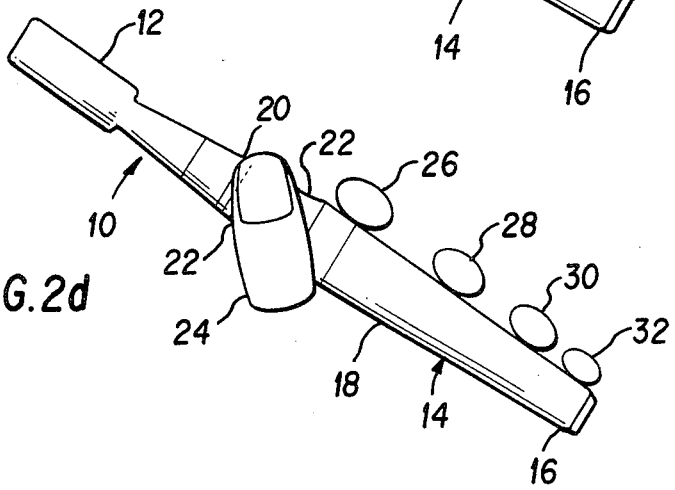
Figure 2A:
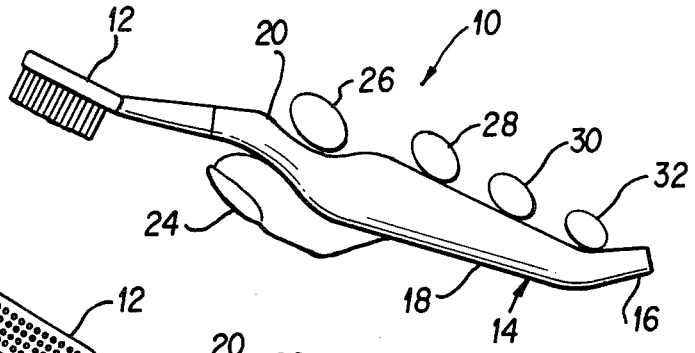
Figure 2B:
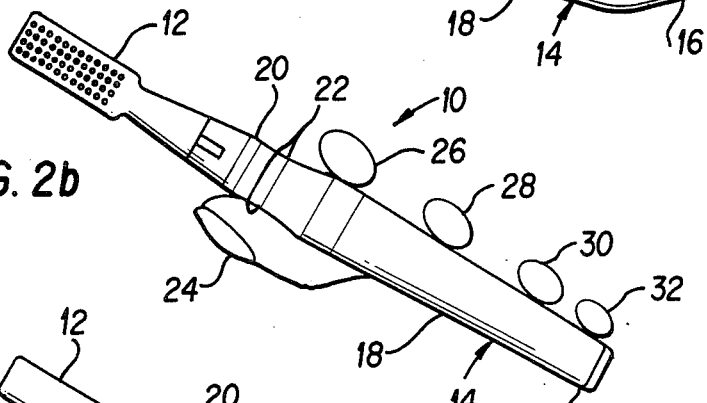
Figure 2C:
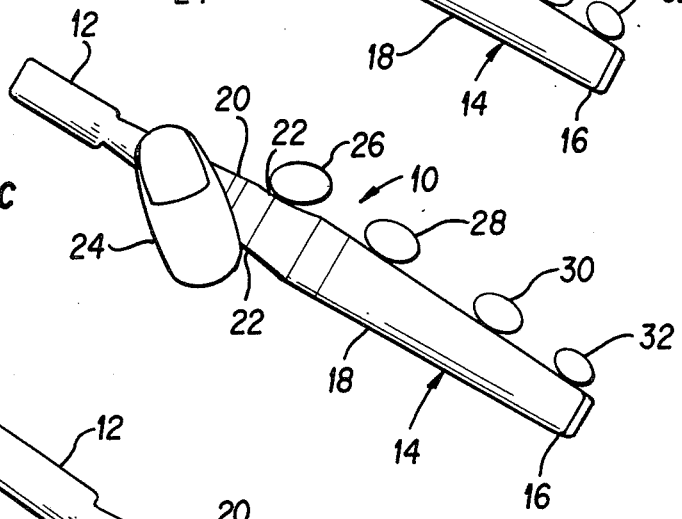
Figure 2D:
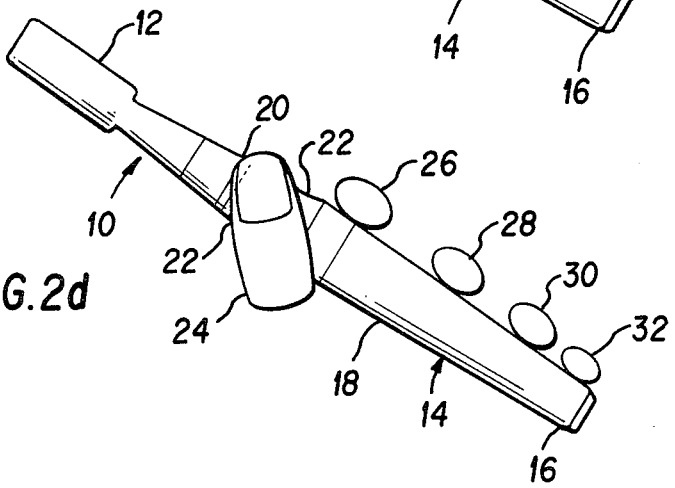

In FIG. 2*d* thumb 24 is contacting the small radius of curvature section of the "S" shaped region 20 of tooth brush 10, with fingers 26–32 being accommodated by the main body region 18 and tail region 16.

Note, the above-described ways of grasping tooth brush 10 are presented as illustrative of the ways that it can be grasped and are not intended to be the only ways. Additionally, tooth brush 10 can be grasped by the left hand in the same ways as illustrated in each of FIGS. 2*a–d*. To make those figures illustrative of left handed grasping of tooth brush 10, one need only make mirror images of them.

Figure 3A:
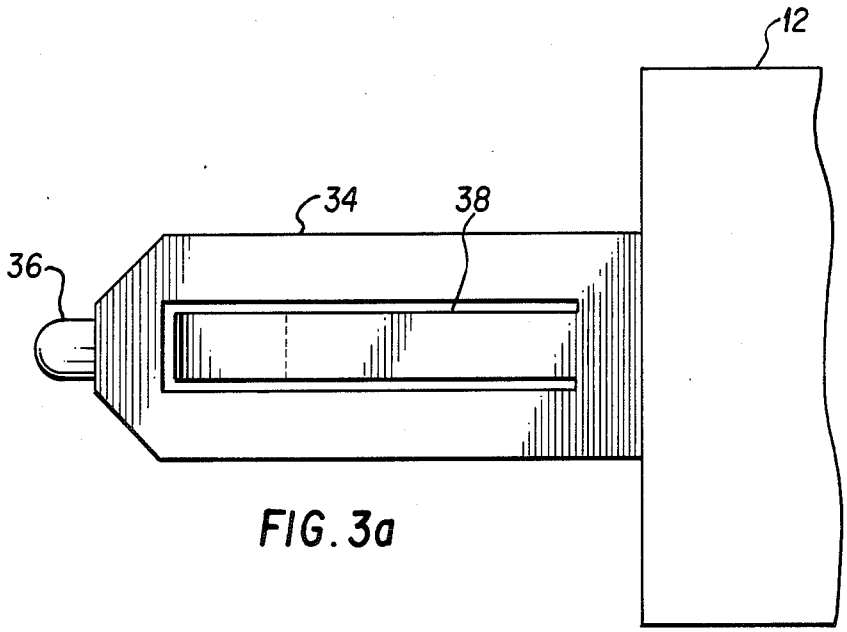
FIGS. 3*a* and *b* show a top and side views, repsectively, of the male latch portion affixed to the brush head of the present invention.
Figure 3B:
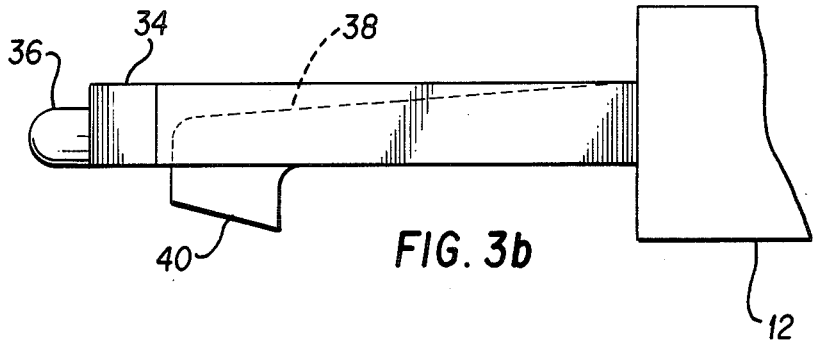
Figure 4:
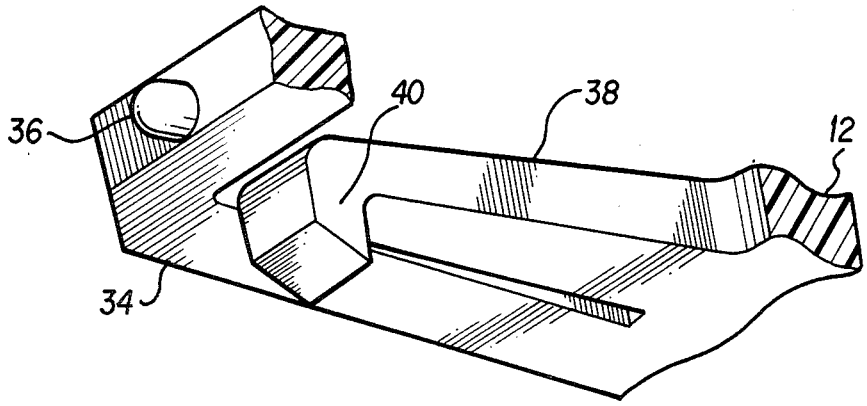
FIG. 4 shows a partial cut-away perspective view of the male latch portion affixed to the brush head of the present invention.

Details of the latching mechanism between the head portion 12 and the handle portion 14 are shown in FIGS. 3–5. The male latch portion is affixed to head portion 12 and the cavity for receiving same is defined in the end of the handle portion 14. FIGS. 3*a–b*, 4 and 5*b* each shows a view of the male latch portion. FIG. 5*a* shows details of the cavity in the end of the handle portion 14 for receiving the male latch portion, and FIGS. 5*c* and *d* illustrate the mating and the release of the latch. While the latching mechanism herein is described as being for the mounting of a removable tooth brush head to a specially design tooth brush handle, it is not intended that this latching mechanism can only be utilized for tooth brushes. The latching mechanism disclosed herein can be utilized in any situation where a firm, yet temporary, attachment is desired.

The male latch portion includes "U" shaped body 34 that has the top of each leg of the "U" attached to the end of the head portion 12 that abuts the handle portion 14 when it is mounted thereto. Within the opening of the "U" there is a spring finger 38 having one end affixed to the same surface of head portion 12 as is the "U" shaped body 34. The free end of spring finger 38 turns downward forming a locking tooth 40. The lower surface of locking tooth 40 is inclined which is shortest furthest from the attached end of spring finger 38. Additionally, affixed to the center of the "U" shaped body 34 at the furthest extent from, and extending away from, head portion 12 is a key 36.

Referring next to FIG. 5*a* there is shown a partial cut-away side plan view of the latch receiving cavity 42 in the end of handle portion 14. It can be seen that cavity 42 defines a space shaped to receive the male latch portion. Cavity 42 includes a ramp 44 up which the lower sloped face of locking tooth 40 advances as the male latch portion is inserted into cavity 42. When fully inserted, locking tooth 40 snaps into recess 52 when key 36 is fully seated into the distal end 48 of cavity 42. In communication with recess 52 from the lower surface of handle portion 14 is a channel 46 for use when the male latch portion is to be released from cavity 42.

Figure 5D:
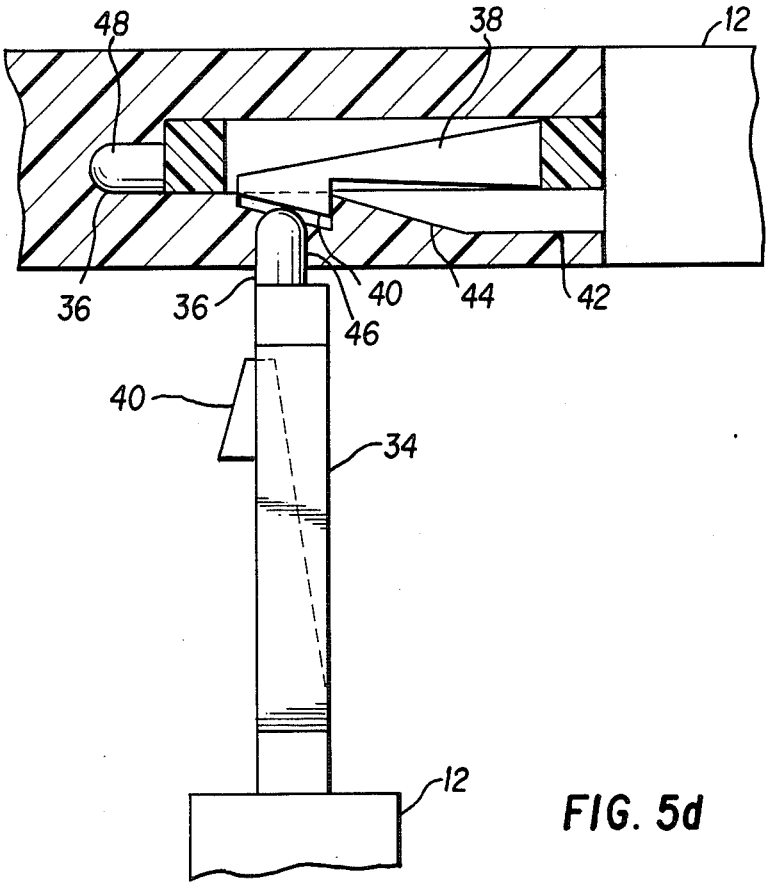
FIG. 5*d* shows by means of a partial cross-section side plan view the male latch portion fully inserted into the cavity of FIG. 5*a* and the tip of the male latch portion of another brush head in position to release the captured male latch portion.

In FIG. 5*c* the male latch portion is partially inserted into cavity 42 with key 36 in alignment with end 48 and the lower face of tooth 40 in contact with ramp 44. In FIG. 5*d* the male latch portion is shown fully inserted into cavity 42 with key 36 in end 48 and locking tooth 40 captured by recess 52. Additionally, FIG. 5*d* illustrates the method for releasing the male latch portion from cavity 42. This is accomplished by inserting key 36 of a second male latch portion into channel 46 to push locking tooth 40 inward to release it from recess 52.

From the forgoing description, it will be apparent that the invention disclosed herein provides novel and advantageous tooth brush and latching mechanism designs. As will be understood by those familiar with the art, the invention may be embodied in other specific forms without departing from the spirit or essential characteristics thereof.

What is claimed is:

1. A tooth brush comprising:

a handle portion in the shape of a bent trapezoid, said handle portion including:

a main body region substantially rectalinear in shape with a length that is several times longer than either its height or width, said main body region defining a top, a bottom and two side surfaces;

a tail region affixed to one end of the main body region angled upward through a selected angle with the top surface of the main body region; and an "S" shaped region affixed to the other end of the main body region with an upper and a lower curved indentation to form the "S" being on the surfaces of the "S" shaped region that are extensions of the top and bottom surfaces of the main body region; and a head portion affixed to the proximate end of the "S" shaped region, said head portion having bristles affixed thereto in a selected pattern.

2. A tooth brush as in claim 1 wherein the upper curved indentation of the "S" shaped region has a smaller radius of curvature than the radius of curvature of the lower curved indentation of the "S" shaped region.

3. A tooth brush as in claim 2 wherein the upper curved indentation begins closer to the main body region than the lower curved indentation, and the lower curved indentation ends closer to the head portion than the upper curved indentation.

4. A tooth brush as in claim 1 wherein the bristles on the head portion extend to the surface thereof that is an extension of the bottom surface of the main body region of the handle portion.

5. A tooth brush as in claim 1 wherein the head portion is removable from the handle portion.

6. A tooth brush as in claim 5 wherein:

said head portion includes a male latching portion, said male latching portion having:

a "U" shaped body, the top of each leg of the "U" being affixed to, and extending outward from, the surface of the head portion that abuts the handle portion when the head portion is affixed to the handle portion; and a spring finger having one end thereof affixed to the same surface to which the legs of the "U" shaped body are affixed and extends outward therefrom between the legs of the "U" shaped body, said finger also has at its other end a locking tooth that extends outward from between the legs of the "U" shaped body; and said handle portion includes a cavity defined within the end of the "S" shaped region shaped to receive the male latching portion of the head portion.

7. A tooth brush as in claim 6 wherein:

said "U" shaped body further includes a key affixed to the outer surface thereof at the furthest extent from the surface to which the legs of the "U" shaped body are affixed; and said handle portion defines within said cavity;

a recess disposed for receiving the locking tooth of the male latching portion to snap into when the male latching portion is fully inserted into said cavity; and a channel between the outer surface of the handle portion and said recess disposed to receive the key of the "U" shaped body of a head portion not mounted on the handle portion to push the locking tooth of a head portion mounted on the handle portion inward as the key is advanced into the channel to release the locking tooth from the recess within the cavity.

8. A tooth brush as in claim 6 wherein:

the end of said locking tooth has an end surface with the edge thereof that is closest to the surface to which the legs of the "U" shaped body are affixed extends further from the the side of the "U" shaped body than the other edge thereof extends; and said cavity of the handle portion further includes an inwardly extending upward sloping ramp disposed to mate with the end of the locking tooth as the male latching portion is inserted into, or withdrawn from said cavity with said recess located beyond said ramp within said cavity.

* * * * *